US012171308B2

(12) United States Patent
Criswell et al.

(10) Patent No.: US 12,171,308 B2
(45) Date of Patent: Dec. 24, 2024

(54) BUCKLE ASSEMBLY

(71) Applicant: Central Lake Armor Express, Inc., Arlington, VA (US)

(72) Inventors: Michael A Criswell, Bellaire, MI (US); Steven R Murphy, Lansing, MI (US); Monica L Russ, Bellaire, MI (US)

(73) Assignee: Central Lake Armor Express, Inc., Arlington, VA (US)

( * ) Notice: Subject to any disclaimer, the term of this patent is extended or adjusted under 35 U.S.C. 154(b) by 44 days.

(21) Appl. No.: 18/103,493

(22) Filed: Jan. 31, 2023

(65) Prior Publication Data

US 2024/0251915 A1 Aug. 1, 2024

(51) Int. Cl.
*A44B 11/26* (2006.01)

(52) U.S. Cl.
CPC ..... *A44B 11/266* (2013.01)

(58) Field of Classification Search
CPC ..... A44B 11/266; A44B 11/2553; A44B 11/2557; Y10T 24/45529
See application file for complete search history.

(56) References Cited

U.S. PATENT DOCUMENTS

| | | | |
|---|---|---|---|
| 1,737,246 | A | 11/1929 | Jones |
| 4,150,464 | A | 4/1979 | Tracy |
| 5,222,279 | A | 6/1993 | Frano et al. |
| 5,619,751 | A | 4/1997 | Ray et al. |
| 6,226,844 | B1 | 5/2001 | Lerra et al. |
| 6,263,548 | B1 | 7/2001 | Ikeda |
| 6,604,265 | B2 | 8/2003 | Giampavolo |
| 6,618,915 | B2 | 9/2003 | Giampavolo |
| 7,140,082 | B2 | 11/2006 | Chen |
| 7,331,088 | B2 | 2/2008 | Pontaoe |
| 7,979,917 | B2 | 7/2011 | Osborne |
| 7,979,966 | B2 | 7/2011 | Yoshie |
| 8,181,319 | B2 | 5/2012 | Johnson et al. |
| 8,191,213 | B2 | 6/2012 | Anscher |
| 8,256,072 | B2 | 9/2012 | Kolasa et al. |

(Continued)

OTHER PUBLICATIONS

Hinge Mark II Original Version Buckles; website (screenshot attached): https://www.psigear.net/military-buckles/hinge-markii-quick-release-buckles.

(Continued)

*Primary Examiner* — Robert Sandy
(74) *Attorney, Agent, or Firm* — Thomas Ring; Inovue Advisors, LLC

(57) ABSTRACT

A buckle assembly includes a male component with a body portion from which a first latch extends in a first direction and a female component, including a frame member having a first lateral side spaced apart from a second lateral side with a gap positioned therebetween. A first aperture extends through the frame member with the first lateral side extending about and defining a first opening of the first aperture, and the second lateral side extending about and defining a second opening of the first aperture, and with the gap in communication with the first aperture. Inserting of the first latch through the gap and into and extending across at least a portion of the first aperture, access is provided, through one of the first opening or the second opening, to a side, positioned within the first aperture for receiving a force for first latch in a second direction.

18 Claims, 11 Drawing Sheets

(56) References Cited

U.S. PATENT DOCUMENTS

| | | | | |
|---|---|---|---|---|
| 8,418,265 | B1 | 4/2013 | Storms, Jr. et al. | |
| 8,464,406 | B2 | 6/2013 | Anscher | |
| 8,595,862 | B2 | 12/2013 | Storms, Jr. et al. | |
| 8,826,462 | B2 | 9/2014 | Storms, Jr. et al. | |
| 9,015,912 | B2 | 4/2015 | Nanbu et al. | |
| D730,238 | S | 5/2015 | Rorich et al. | |
| 9,651,339 | B2 | 5/2017 | Storms, Jr. et al. | |
| 9,730,495 | B2 * | 8/2017 | Howell | A44B 11/25 |
| 9,750,310 | B2 * | 9/2017 | Kolasa | A44B 11/266 |
| 9,986,791 | B2 * | 6/2018 | Botkus | A44B 11/2592 |
| 10,104,943 | B2 | 10/2018 | Haider et al. | |
| 10,588,383 | B2 * | 3/2020 | Nanbu | A44B 11/2592 |
| 10,893,708 | B1 | 1/2021 | Burnsed, Jr. et al. | |
| 2007/0089280 | A1 | 4/2007 | Pontaoe | |
| 2016/0021984 | A1 * | 1/2016 | Mundhra | A44B 11/2565 116/137 R |
| 2019/0154404 | A1 | 5/2019 | LeMarbe et al. | |
| 2020/0229547 | A1 | 7/2020 | LeMarbe et al. | |
| 2021/0045470 | A1 | 2/2021 | Martinez | |
| 2022/0349431 | A1 | 11/2022 | Haider et al. | |

OTHER PUBLICATIONS

ITW GTSR Wavelock; website (screenshot attached): https://na.itwnexus.com/content/gtsr-waveloc-latch-0.

ITW Nexus North America Cobra quick release buckles/GT Cobra; website (screenshot attached): https://na.itwnexus.com/products/categories/plastic-buckles/gt-cobra%E2%84%A2.

National Molding Tactik Buckle; website (screenshot attached): https://soldiersystems.net/2018/09/25/mdm-18-national-molding-tactik-buckle/.

Point Blank Enterprises KWIQ-Clip; website (screenshot attached): https://www.pointblankenterprises.com/paraclete/kwiq-clip.html.

* cited by examiner

BUCKLE ASSEMBLY

FIELD

This disclosure relates to a buckle assembly for securing a garment to a wearer and more particularly, to a buckle assembly that provides quick release of the garment from the wearer.

BACKGROUND

Buckle assemblies are commonly used in association with other connecting items such as straps or webs for securing a garment to a wearer. These buckle assemblies commonly include a male portion and a female portion, wherein the male portion of the buckle assembly, for example, may have a pair of flexible latches for engaging the female portion of the buckle assembly. With inserting the latches of the male portion into the female portion, the latches of the male portion are flexed in a direction away from a normal unflexed relaxed position. With the latches of the male portion sufficiently inserted within the female portion, the latches are permitted to unflex within the female portion such that the latches flex back in an opposite direction and become positioned in a blocking relationship with a portion of the female portion. With the latches positioned in the blocking relationship with a portion of the female portion, the male portion is blocked from being removed from the female portion of the buckle assembly and the male portion and the female portion are in a locked position.

To disengage the male and female portions from a locked position, the latches of the male portion are flexed in the direction the latches were flexed at the time the latches were inserted into the female portion thereby moving the latches out of the blocking relationship with the female portion and positioning the male portion and the female portion in an unlocked position. With the latches out of the blocking relationship with the female portion, the male portion can then be withdrawn from the female portion of the buckle assembly.

Garments, such as a tactical ballistic vest, for example, need to be able to be quickly removed from the wearer. This quick removal of the garment requires the buckle assemblies which secure the garment to the wearer to be likewise quickly released. Numerous circumstances arise which require quick release of a buckle assembly to facilitate quick removal of the garment from the wearer. One circumstance may include when a wearer of the garment enters a deep-water environment and removal of the garment improves the buoyancy of the wearer. Another circumstance can arise when the wearer of the garment needs immediate medical attention, where the garment may hinder accessing a portion of the body of the wearer that needs the medical attention. Other circumstances, for example, may arise where convenience is needed by the wearer who experiences cycles of wearing, removing and putting back on the garment in the field. Quick and convenient disengagement of the buckle system and thereby removal of the garment from the wearer is a benefit to the wearer.

Quick release buckle systems have various quick release configurations. These quick release configurations can include, with the male and female portions engaged in a locked position, the latches of the male portion are positioned on the exterior of the buckle assembly allowing quick access to the latches. Other quick release configurations which facilitate quick disengagement of the buckle assembly include a cord or strap extending from the buckle assembly which, with pulling on the cord or strap, releases the latch(es) from engagement with the female component of a locked buckle assembly. However, these quick release configurations can, at the same time, be detrimental to the wearer.

Should the wearer of the garment be operating in an environment which, for example includes, maneuvering in rough terrain, being in contact with the ground, moving in proximity to heavy plant growth, operating within confining structures, or in contact with a combatant or perpetrator all such circumstances provide opportunities for the quick release configurations to be activated by way of contact. This contact can result in disengagement of buckle assemblies resulting in the removal of the garment or at least portions thereof thereby compromising optimal protection to the wearer during operations.

Thus, a problem arises with providing quick release configurations for quick disengagement of a buckle assembly providing quick removal of a protective garment in that such quick release buckle assembly configurations are susceptible to and can experience a contact from the wearer's environment which disengages the buckle assembly which causes the protective garment to not be able to provide optimal protection to the wearer during operations.

Moreover, there is a need for an edge portion of at least one of a male and female portion of a buckle system to be further secured in a direction toward the protective garment and the body of the wearer to maintain a secure and stable securement of the buckle assembly with respect to the garment being secured and with the buckle assembly maintaining a minimal profile with respect to the protective garment.

SUMMARY

A buckle assembly includes a male component which includes a body portion from which a first latch extends in a first direction; and a female component, including a frame member has a first lateral side spaced apart from a second lateral side. A gap is positioned between the first lateral side and the second lateral side. A first aperture extends through the frame member with the first lateral side extending about and defining a first opening of the first aperture, and the second lateral side extending about and defining a second opening of the first aperture. The gap is in communication with the first aperture. With inserting the first latch through the gap and into and across a portion of the first aperture, access is provided, through one of the first opening or the second opening, to a side, positioned within the first aperture for receiving a force for first latch in a second direction.

A method for operating a buckle assembly, includes a step of inserting a first latch, which extends in a first direction from a body portion of a male component, through a gap within a frame member of a female component. The gap is positioned between a first lateral side spaced apart from a second lateral side of the frame member, wherein a first aperture extends through the frame member such that the first lateral side extends about and defines a first opening of the first aperture and the second lateral side extends about and defines a second opening of the first aperture. The gap is in communication with the first aperture. The method further includes another step of moving the first latch beyond the gap and into the first aperture such that the first latch moves across a portion of the first aperture providing access to a side of the first latch positioned within the first aperture for receiving a force onto the side in a second direction for moving the first latch in the second direction across the first aperture. Access is provided to the side of the first latch through one of the first opening or the second opening.

A buckle assembly includes a male component and a female component with the male component including a body portion and the female component including a frame member. At least one of the body portion or the frame member have an edge portion which has a tapered configuration.

The features, functions, and advantages that have been discussed can be achieved independently in various embodiments or may be combined in yet other embodiments further details of which can be seen with reference to the following description and drawings.

Figure 1:
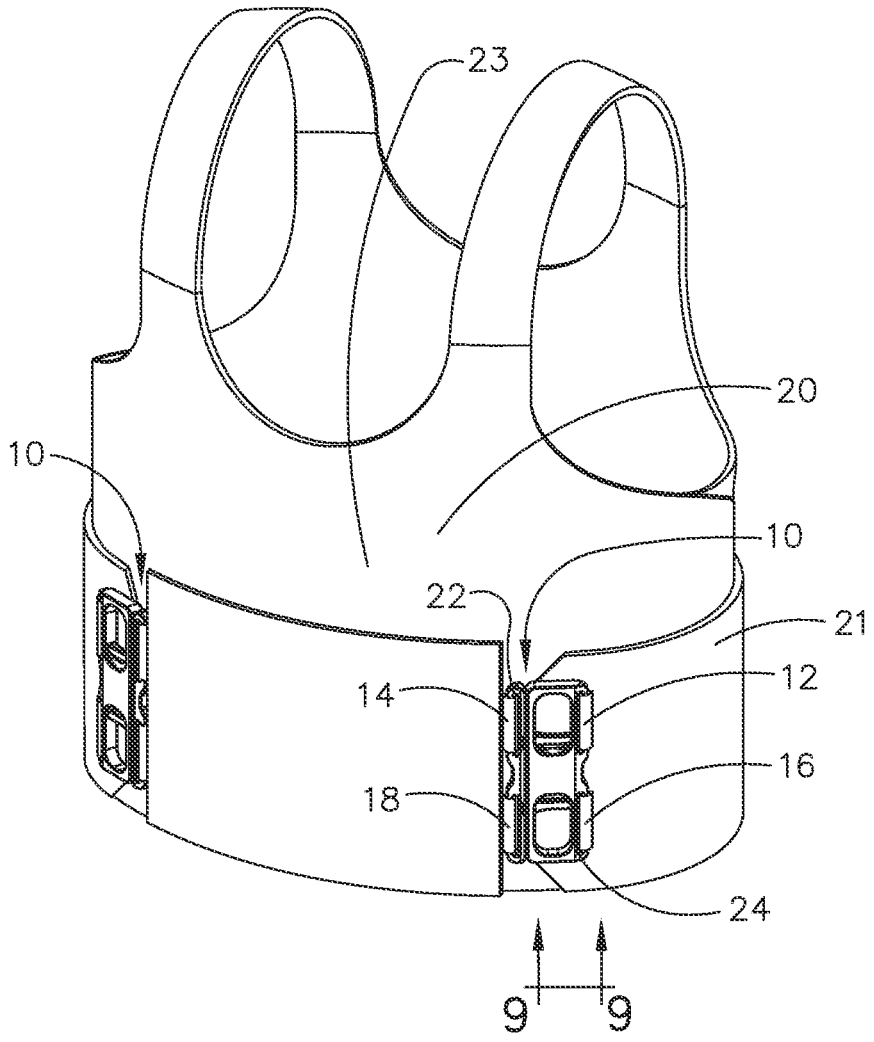
FIG. 1 is a perspective view of the buckle assembly in use with respect to a tactical vest.
Figure 2:
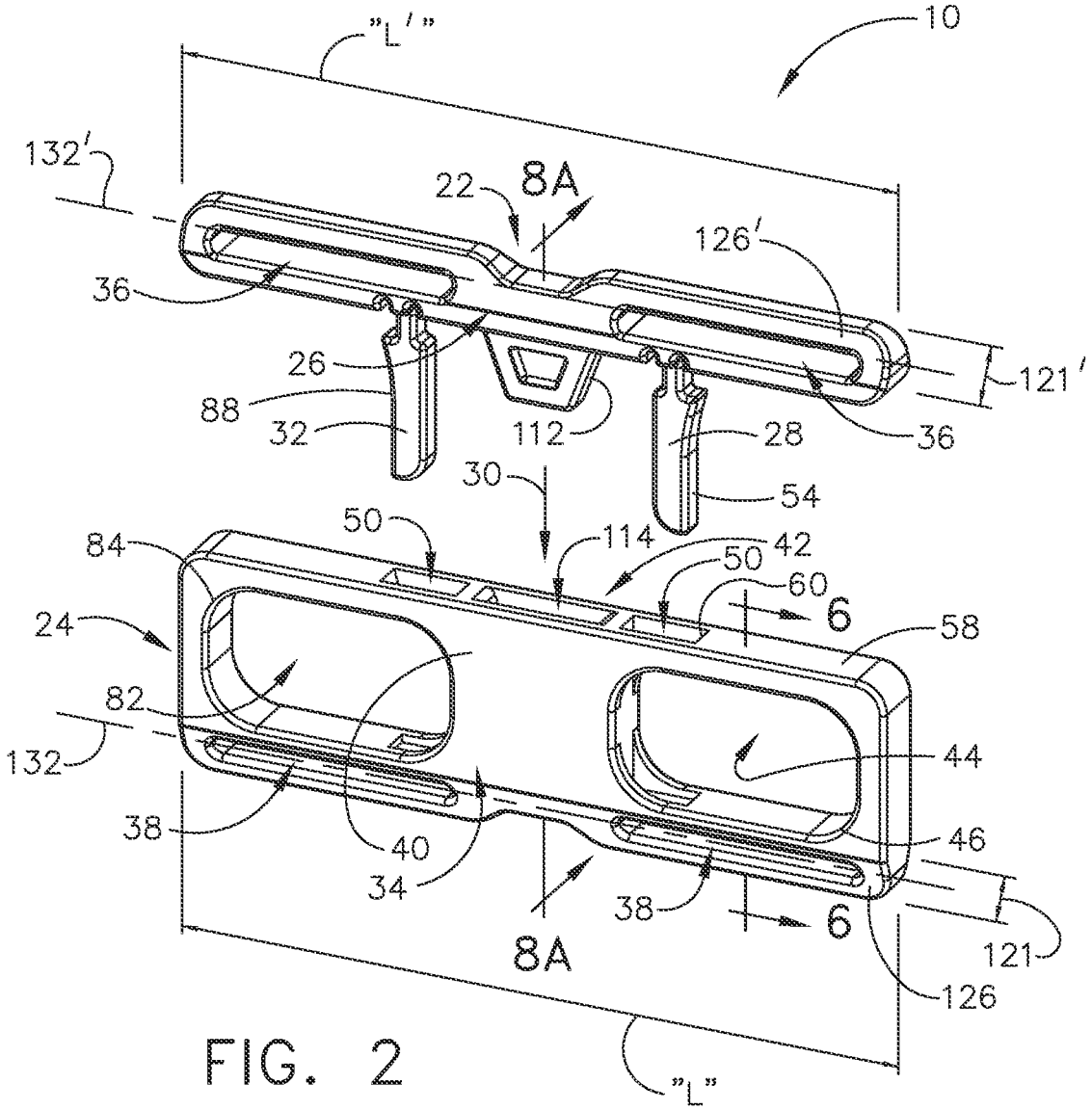
FIG. 2 is an exploded perspective view of a front side of the male component and the female component of the buckle assembly.
Figure 8A:
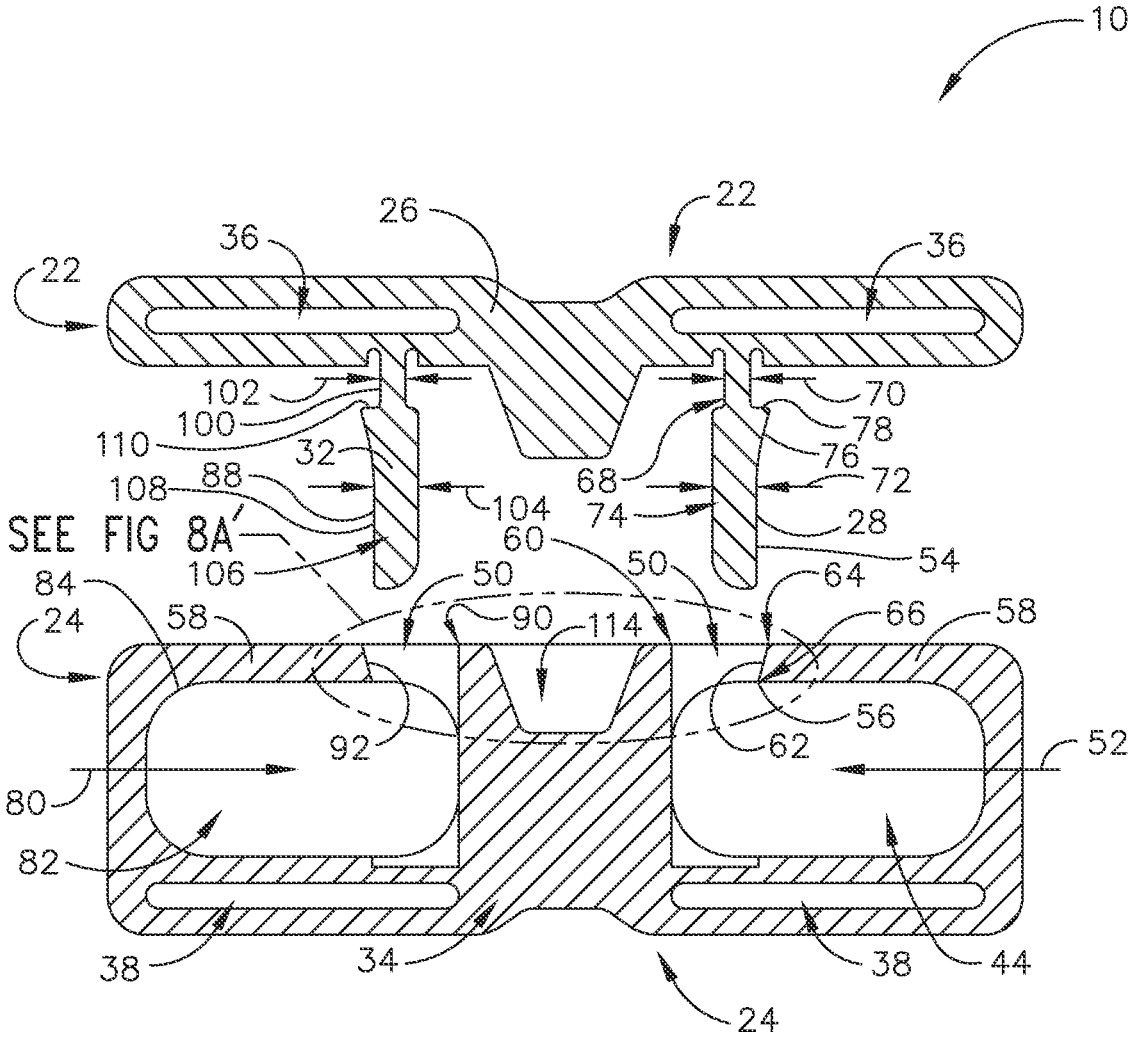
FIG. 8A is an exploded cross section view of the male component and the female component along line 8A-8A of FIG. 2.
Figure 8A:
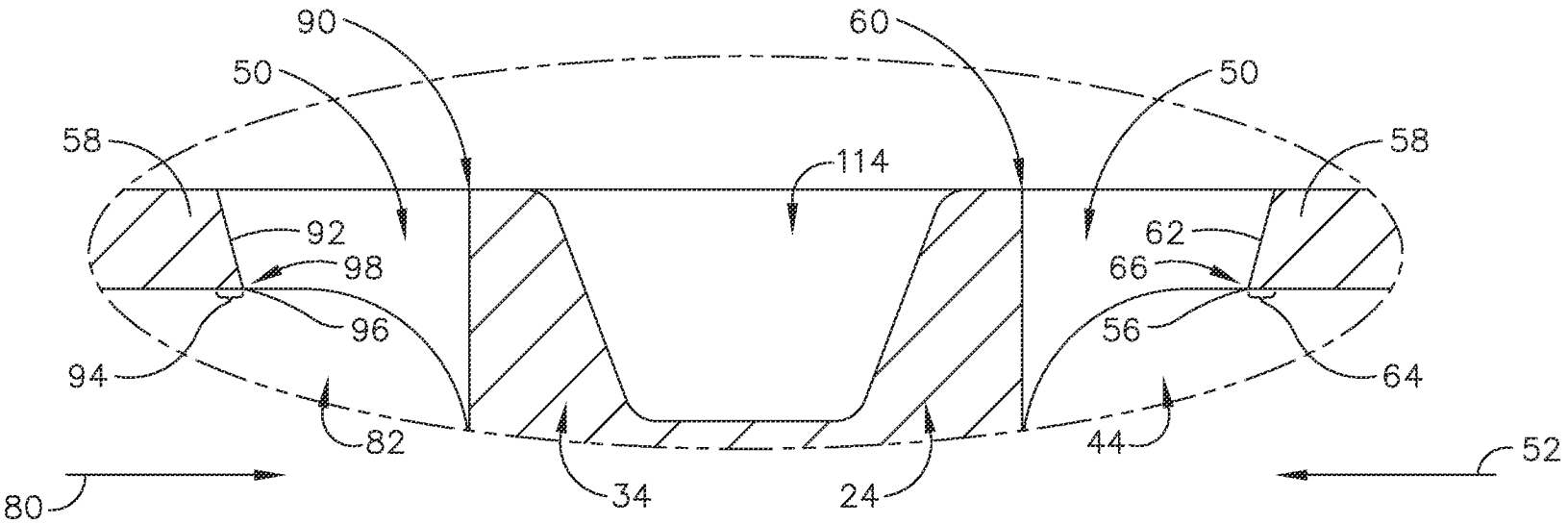
Figure 8B:
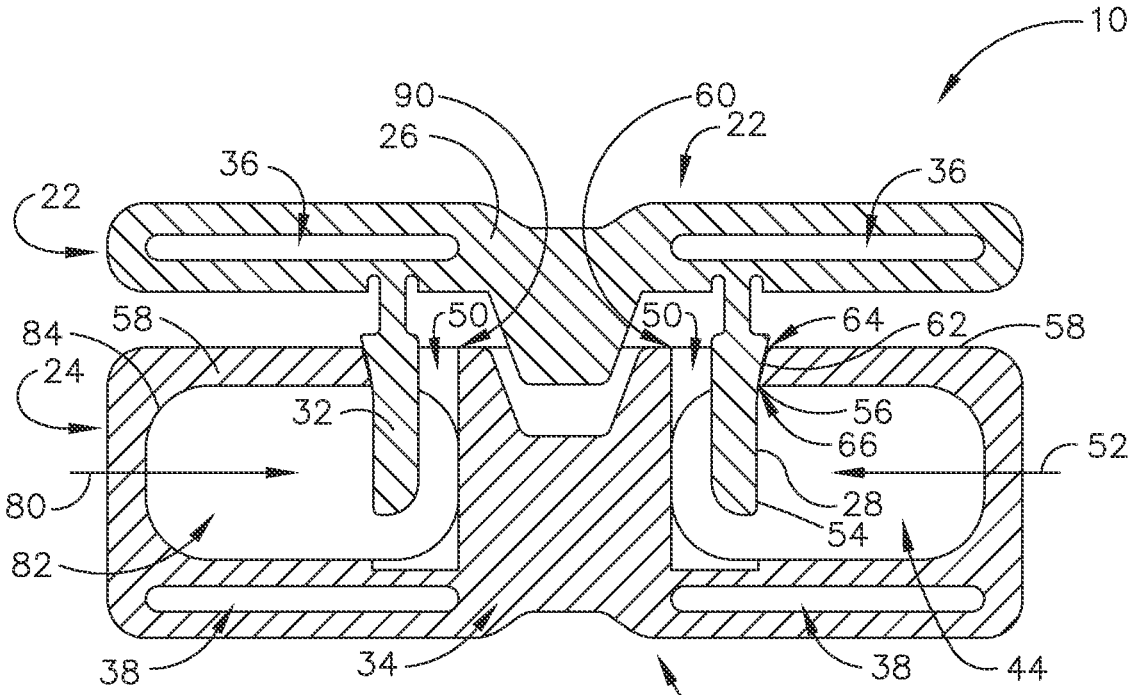
Figure 8C:
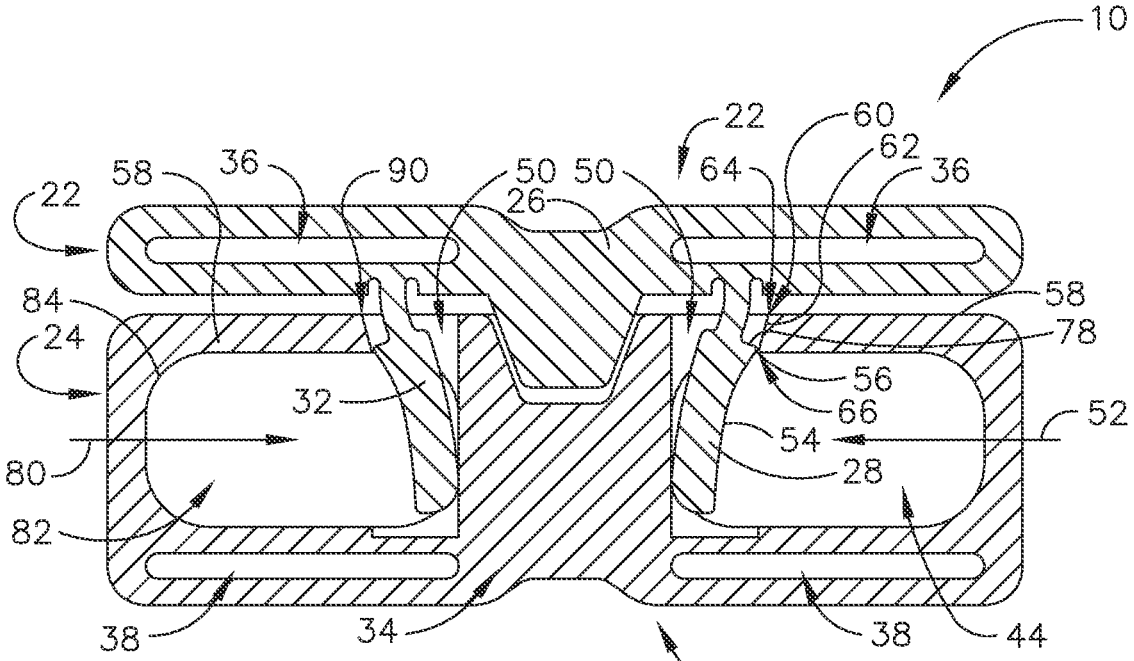
Figure 8D:
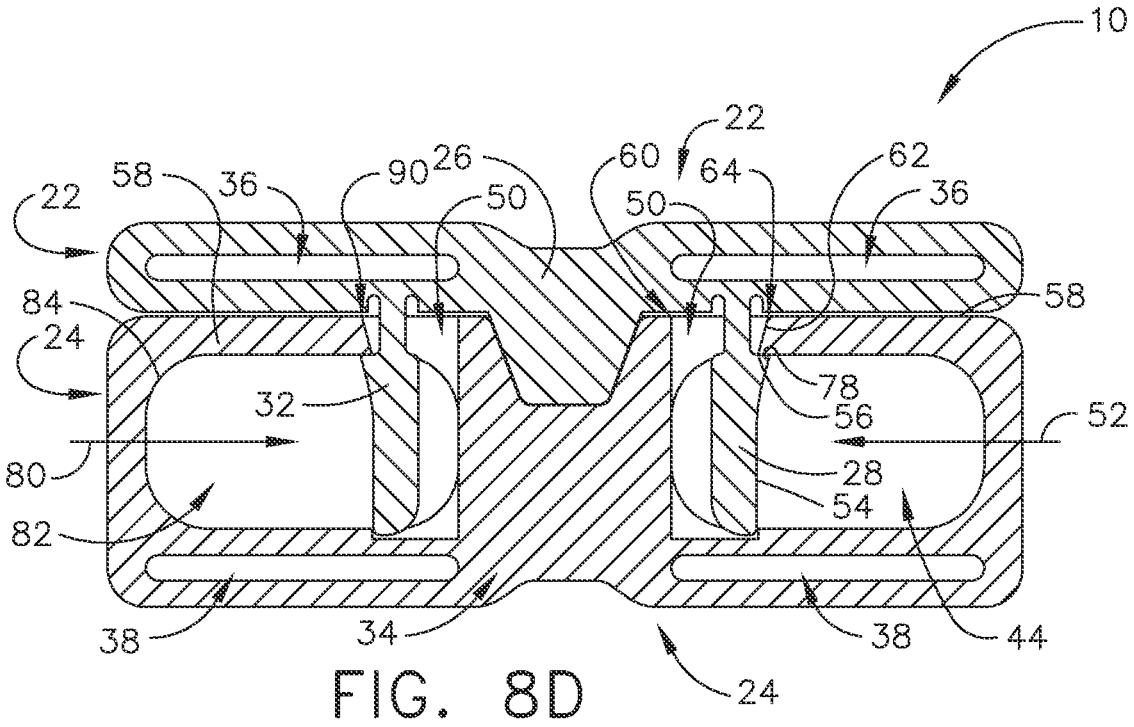
Figure 8E:
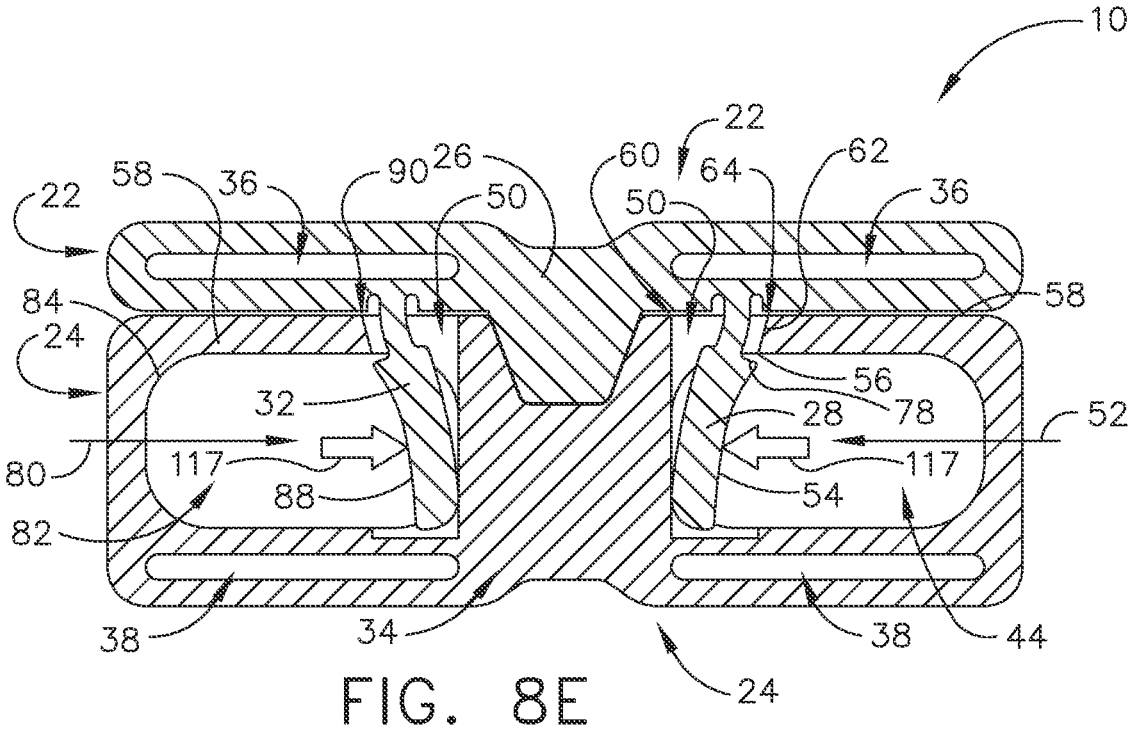
Figure 9:
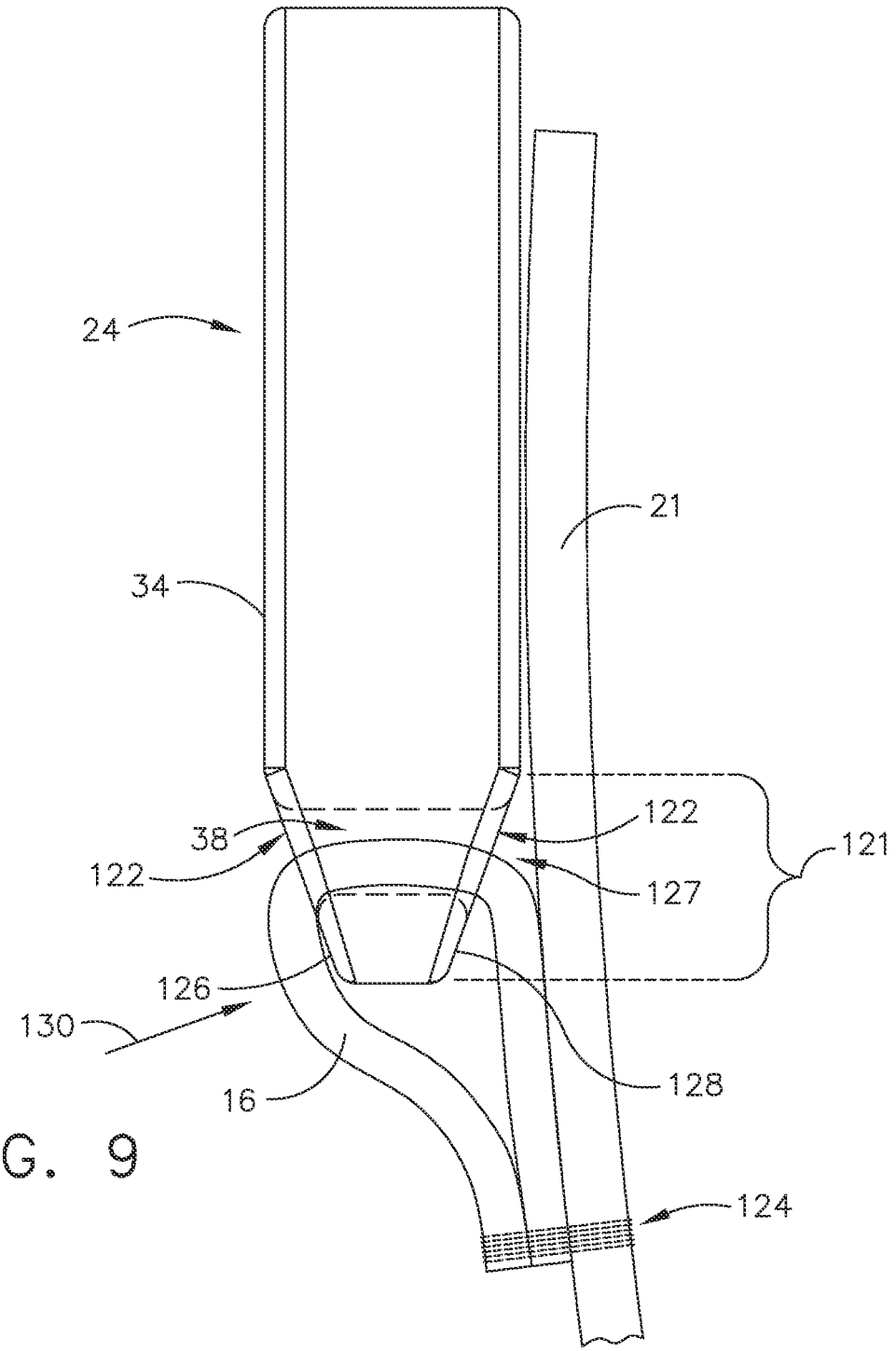
Figure 10:
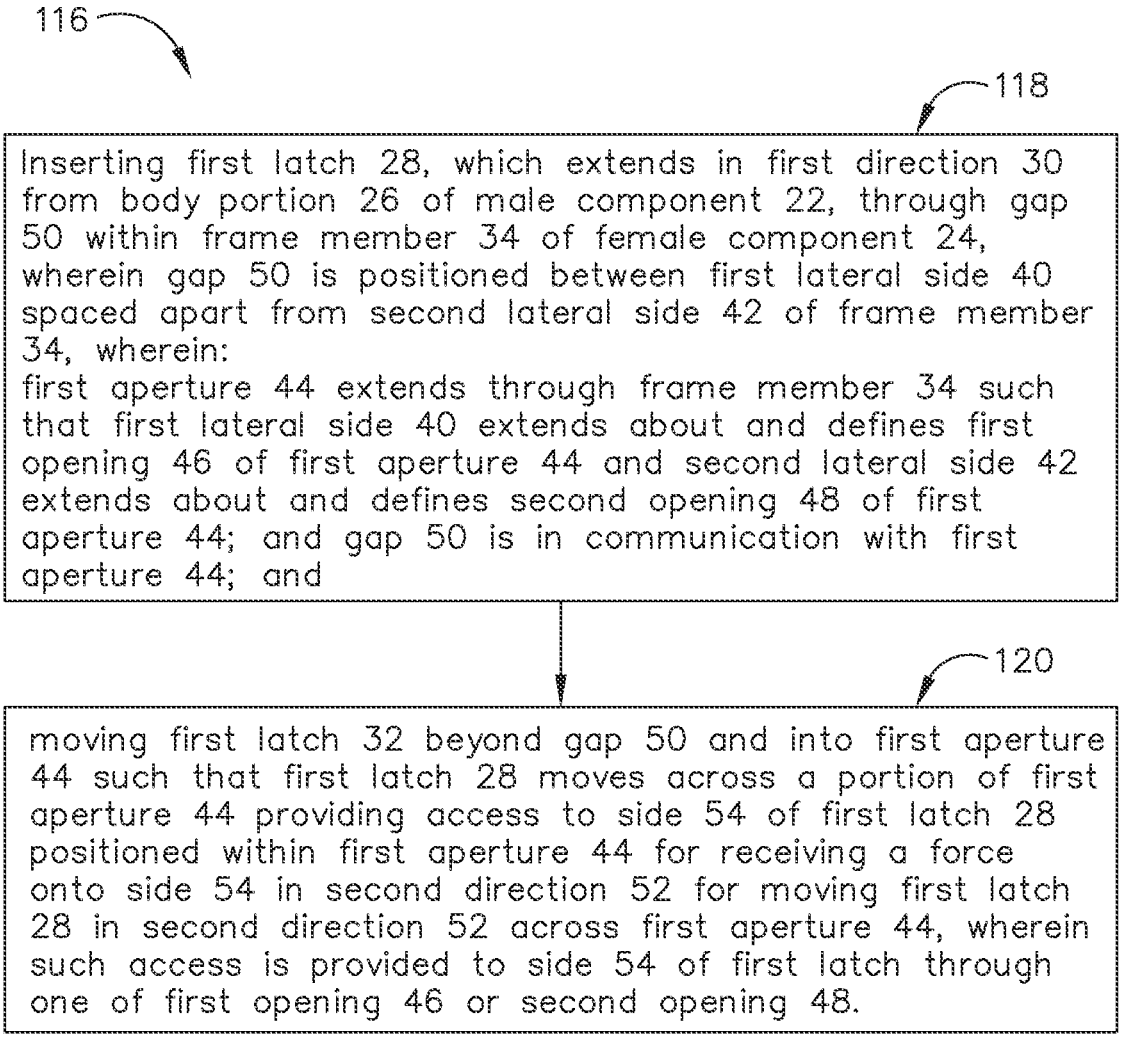

component along line 8A-8A of FIG. 2;

FIG. 8A' is an enlarged view of the portion of the female component encircled in FIG. 8A;

FIG. 8B is the cross section view as seen in FIG. 8A, with the latches of the male component in contact with the first and second inclined surfaces of a side wall of the frame member of the female component with the male component being inserted into the female component;

FIG. 8C is the cross section view of FIG. 8B with the male component further inserted into the female component than as shown in FIG. 8B and first and second latches are flexing toward one another;

FIG. 8D is a cross section view of FIG. 8C with the first and second latches further inserted into the female component than as seen in FIG. 8C, first and second latches have flexed away from one another and a first ledge portion of the first latch and a second ledge portion of the second latch are positioned in abutting relationship with the side wall of the frame member of the female component, placing the male and female components into a locked position;

FIG. 8E is a cross section view of FIG. 8D with a squeezing force being applied to the first and second latches, the first ledge portion and the second ledge portion are moved out of abutting relationship with the side wall of the frame member of the female component positioning the male and female components in an unlocked position;

FIG. 9 is an enlarged side perspective view of a portion of the female component of the buckle assembly as seen along line 9-9 in FIG. 1 with a partial schematic representation of a side panel of the tactical vest and with a strap member extending through a slot of the female component for securing the female component of the buckle assembly to the side panel; and FIG. 10 is a flow chart of a method for operating the buckle assembly.

Before any embodiment(s) of the invention are explained in detail, it is to be understood that the invention is not limited in its application to the details of construction and the arrangements of the components set forth in the following description or illustrated in the drawings. The invention is capable of other embodiments and of being practiced or carried out in various ways. Also, it is understood that the phraseology and terminology used herein are for the purpose of description and should not be regarded as limiting.

DESCRIPTION

Referring to FIGS. 1 and 2, buckle assembly 10 is used in securing garments to a wearer. Buckle assemblies 10 are used, for example, in conjunction with strap members, webs, or other known connector configurations to facilitate securement of a garment to a wearer. As seen in an example of use of buckle assemblies 10 in FIG. 1, strap member loops 12, 14, 16 and 18 are secured to tactical vest 20 and in turn the loops are secured to buckle assembly 10. In this example strap member loops 12 and 16 are secured to side strap 21 of tactical vest 20 and to female component 24 of buckle assembly 10. Strap loop members 14 and 18 are secured to a torso portion 23 of tactical vest 20 and to male component 22 of buckle assembly 10. Numerous other connector configurations can be used, such as for example a free end strap or webbing depending on the securing arrangement desired.

As seen in FIGS. 1 and 2, buckle assembly 10, includes, in this example, a male component 22 and female component 24. Buckle assembly 10 can be constructed of various known materials such as plastic or other suitable, durable and impact resistant materials. Various methodologies of fabrication of buckle assembly 10 can be employed such as, for example, molding, printing or welding or other known methodologies as well as combinations of methodologies.

Male component 22 includes a body portion 26 which has a first latch 28 which extends from body portion 26 in first direction 30 and has a second latch 32 which also extends from body portion 26 in first direction 30 spaced apart from first latch 32. Female component 24 includes frame member 34. Body portion 26 of male component 22 defines at least one slot 36, in this example, two slots 36 are shown, through which a strap member (not shown) in FIG. 2 can be extended through each slot 36 in securing the strap member to male component 22 and in turn facilitating securing male component 22 to a garment. Frame member 34 of female component 24 defines at least one slot 38, in this example, two slots 38 are shown, through which another strap member, (not shown) in FIG. 2 can be extended through each slot 38 in securing the other strap member to female component 24 and in turn facilitating securing female component 24 to a garment.

In the example of buckle assembly 10 shown in FIGS. 2-8E, first and second latches 28 and 32 of male component 22 work together with respect to locking together female component 24 and male component 22. The following description of buckle assembly 10 will first address the interaction of first latch 28 with respect to female component 24 followed by a similar description of the interaction of second latch 32 with female component 24.

Figure 3:
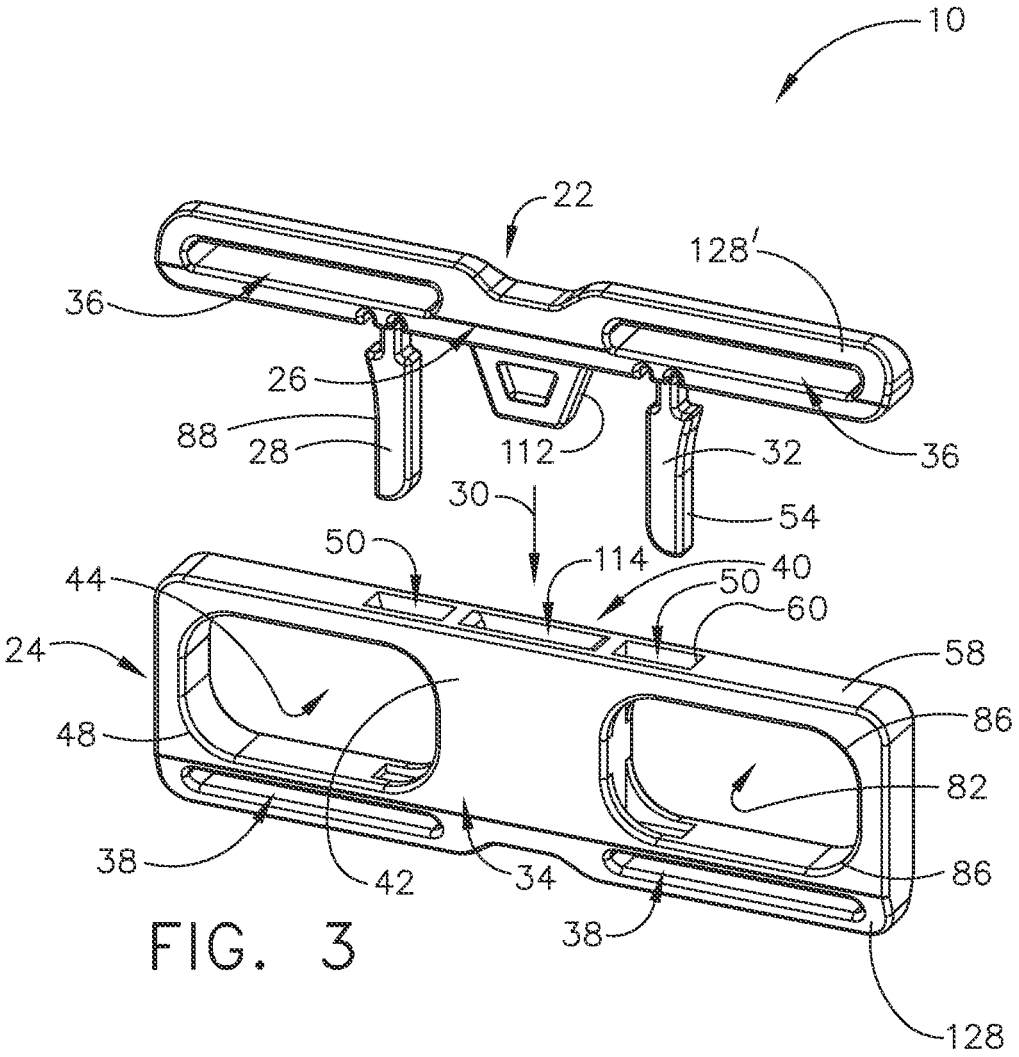
FIG. 3 is an exploded perspective view of FIG. 2 of a reverse side of the male component and the female component of the buckle assembly.

In referring to FIGS. 2 and 3, frame member 34 has first lateral side 40 spaced apart from second lateral side 42 with gap 50 positioned therebetween, as seen in FIGS. 2, 3, 7 and 8A. First aperture 44 extends through frame member 34 such that first lateral side 40, as seen in FIG. 2, extends about and defines first opening 46 of first aperture 44. Second lateral side 42 extends about and defines second opening 48 of first aperture 44. Gap 50, as seen in FIGS. 2, 3, 7 and 8A, is in communication with first aperture 44, as seen in FIGS. 8A-8E, such that gap 50 and first aperture 44 are open to one another.

With inserting of first latch 28 through gap 50 and into and across a portion of the first aperture 44, as seen in FIGS. 8A and 8B-8D, first latch 28 moves into and extends across a portion of first aperture 44, as seen in FIGS. 8B-8D. Access is provided through one of first opening 46 or the second opening 48, to side 54, positioned within first aperture 44 of first latch 28 such that a force can be received by side 54 in second direction 52 to move first latch 28 in second direction 52 across first aperture 44, as seen in FIG. 8E. Entering first aperture 44 through one of first opening 46 or second opening 48, as seen in FIGS. 2 and 3, can be done simply, for example, with a finger or thumb of the wearer entering frame member 34 through first opening 46, for example, and into first aperture 44 and positioning the wearer's finger or thumb against side 54 of first latch 28, as seen in FIGS. 2-4, 8D, and 8E.

Figure 7:
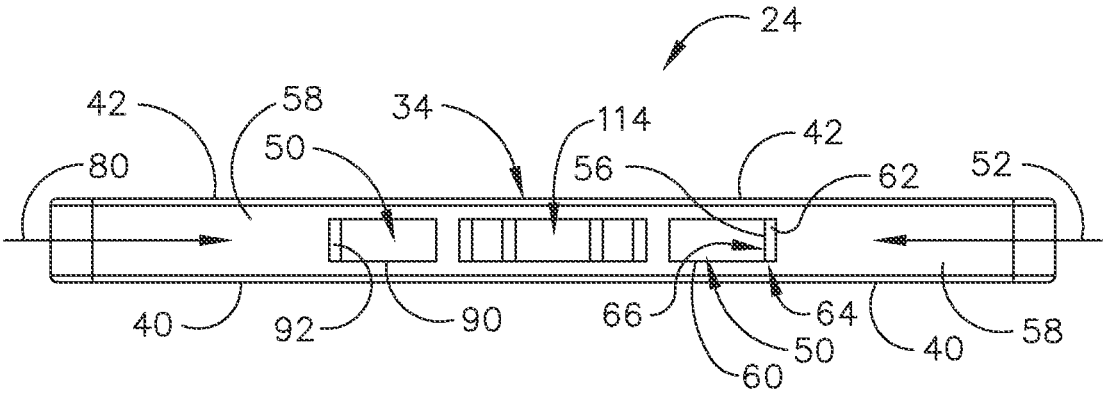
FIG. 7 is a top view of the female component of the buckle assembly.

In this example of buckle assembly 10, frame member 34 includes side wall 58 which extends between and along first lateral side 40 and second lateral side 42 such that side wall 58, as seen in FIG. 7, defines opening 60 which is in communication with gap 50 and with first aperture 44, as seen in FIG. 8A. Side wall 58 includes first inclined surface 62 positioned to extend in gap 50 as seen in FIGS. 7 and 8A-8E. First inclined surface 62 is positioned between first lateral side 40 and second lateral side 42 of frame member 34, as seen in FIG. 7. As seen in FIGS. 7 and 8A', portion 64 of side wall 58, includes first inclined surface 62 which extends in second direction 52 to first edge 56 of portion 64 of which is positioned at end 66 of first inclined surface 62.

As seen in FIG. 8A, first latch 28 has first portion 68 which has a thinner dimension 70 than dimension 72 of second portion 74 of first latch 28. First portion 68 is positioned between body portion 26 of male component 22 and second portion 74 of first latch 28. First portion 68 of first latch 28 is recessed from external surface 76 of second portion 74 of first latch 28. First ledge portion 78 extends from first portion 68 of first latch 28 to external surface 76 of second portion 74 of first latch 28.

With inserting of first latch 28 into frame member 34 of female component 24 through opening 60 and gap 50, first latch 28 slides along first inclined surface 62 causing first latch 28 to flex in second direction 52, as seen in FIGS. 8A and 8B-8C. When first latch 28 has been sufficiently inserted into first aperture 44 within frame member 34 such that first ledge portion 78 of first latch 28 becomes positioned beyond first edge 56 positioned at end 66 of first inclined surface 62 of side wall 58, as seen in FIGS. 8C-8D, such results in first latch 28, with a resilient material construction, to flex in third direction 80 such that first ledge portion 78 is positioned in abutting relationship with side wall 58. The abutting relationship places male component 22 and female component 24 in a locked relationship.

With first ledge portion 78 in abutting relationship with side wall 58, side 54 of first latch 28 is accessible within first aperture 44 within frame member 34 and the force is received by side 54 in second direction 52 resulting in flexing first latch in second direction 52 and moving first ledge portion 78 and side wall 58 out of abutting relationship. With moving first ledge portion 78 out of abutting relationship with side wall 58, as seen in FIG. 8E, male component 22 and female component 24 are unlocked from one another, such that male component 22 and female component 24 can be separated from one another, with cooperation, in this example, of second latch 32 described below.

As seen in FIGS. 2 and 3, body portion 26 has second latch 32, which extends from body portion 26 in the first direction 30 with first latch 28 and second latch 32 spaced apart from one another. Female component 24 has second aperture 82 which extends through frame member 34 and spaced apart from first aperture 44. First lateral side 40 extends about and defines third opening 84 of second aperture 82 and second lateral side 42 extends about and defines fourth opening 86. Gap 50, as mentioned earlier and as seen in FIGS. 2, 3, 7, and 8A, is positioned between first lateral side 40 and second lateral side 42 with gap 50 in communication with second aperture 82, as seen in FIGS. 8A-8E. With inserting of the second latch 32 through gap 50 and into and across a portion of second aperture 82, as seen in FIGS. 8A and 8B-8E, access is provided, through one of third opening 84 or fourth opening 86, to side 88, positioned within second aperture 82 of second latch 32 for receiving a force in third direction 80, as seen in FIGS. 2-5, 8A and 8E. As mentioned earlier this access can be easily accomplished by the wearer, as was discussed earlier with respect to accessing side 54 of first latch 28, with utilizing the other of a finger or thumb, for example, than used with respect to first aperture 44, to extend through third opening 84 to enter second aperture 82, such that the force applied by the other of the finger or thumb is received against side 88 of second latch 32.

Buckle assembly 10 further includes side wall 58, as mentioned earlier, which extends between and along first lateral side 40 and second lateral side 42 such that side wall 58 defines another opening 90, as seen in FIG. 7, which is in communication with gap 50 and with second aperture 82, as seen in FIG. 8A'.

Side wall 58 includes second inclined surface 92 which extends into gap 50. Second inclined surface 92 is positioned between first lateral side 40 and second lateral side 42 of frame member 34. Another portion 94 of side wall 58, which includes second inclined surface 92, extends in third direction 80 to second edge 96 of the other portion 94 of side wall 58, which is positioned at end 98 of second inclined surface 92.

As seen in FIG. 8A, second latch 32 has first portion 100 which has a thinner dimension 102 than dimension 104 of second portion 106 of second latch 32. First portion 100 is positioned between body portion 26 of male component 22 and second portion 106 of second latch 32. First portion 100 of second latch 32 is recessed from external surface 108 of second portion 106 of second latch 32. Second ledge portion 110 extends from the first portion 100 of second latch 32 to external surface 108 of second portion 106 of second latch 32.

As seen in FIGS. 7 and 8A-8E, with inserting of second latch 32 into frame member 34 of female component 24 through other opening 90, second latch 32 slides along second inclined surface 92 causing second latch 32 to flex in third direction 80. With having sufficiently inserted second latch 32 into second aperture 82 of frame member 34, second ledge portion 110 of second latch 32 becomes positioned beyond second edge 96 positioned at end 98 of second inclined surface 92 of other portion 94 of side wall 58, resulting in second latch 32 to flex in second direction 52 such that second ledge portion 110 of second latch 32 is positioned in abutting relationship with side wall 58 locking male component 22 and female component 24 together.

With second ledge portion 110 in abutting relationship with side wall 58, side 88 of second latch 32 is accessed within second aperture 82 within frame member 34 and the force is applied is received by side 88 in third direction 80, as seen in FIG. 8E, resulting in flexing second latch 32 in third direction 80 and moving second ledge portion 110 and side wall 58 out of abutting relationship unlocking male component 22 and female component 24.

Male component 22 includes guide element 112 secured to body portion 26 extending in first direction 30 and positioned between first latch 28 and second latch 32, as seen in FIGS. 2 and 3. Side wall 58 of female component 24 defines guide opening 114 which extends into frame member 34 for receiving guide element 112. Guide element 112 provides wearer assistance in aligning male component 22 and female component 24 to secure them together into a locked position and at the same time provide additional reinforcement to buckle assembly 10.

Method 116 for operating buckle assembly 10, as seen in FIG. 10, includes step of inserting 118 inserting first latch 28, which extends in first direction 30 from body portion 26 male component 22, as seen in FIGS. 2 and 3, through gap 50 within frame member 34 of female component 24. Gap 50 is positioned between first lateral side 40 spaced apart from second lateral side 42 of frame member 34, as seen in FIGS. 7 and 8A. First aperture 44 extends through frame member 34 such that first lateral side 40 extends about and defines first opening 46 of first aperture 44 and second lateral side 42 extends about and defines second opening 48 of first aperture 44, as seen in FIGS. 2 and 3. Gap 50 is in communication with first aperture 44, as discussed earlier, and seen in FIG. 8A.

Method 116 further includes a step of moving 120, as seen in FIG. 10, first latch 28 beyond gap 50 and into first aperture 44 such that first latch 28 moves across a portion of first aperture 44, as seen in FIGS. 8A and 8B-8D, providing access to side 54 of first latch 28 positioned within first aperture 44 for receiving a force onto side 54 in a second direction 52 for moving first latch 28 in second direction 52 across first aperture 44, wherein such access is provided through one of the first opening 46 or second opening 48.

Method 116 further includes a step of inserting second latch 32 of body portion 26 of male component 22, which is spaced apart from first latch 28 and which extends in first direction 30, as seen in FIGS. 2 and 3, through gap 50 positioned within frame member 34 positioned 34, as seen in FIGS. 2, 3, 7, 8A, and 8B. Second aperture 82, as seen in FIGS. 2 and 3, extends through the frame member 34 such that first lateral side 40 extends about and defines a third opening 84 of second aperture 82 and the second lateral side 42 extends about and defines a fourth opening 86 of second aperture 82. Gap 50 is in communication with the second aperture as seen in FIG. 8A.

Method 116 further includes moving second latch 32 beyond gap 50 and into the second aperture such that second latch 32 moves across a portion of second aperture 82 providing access to side 88 of second latch 32 positioned within second aperture 82 for receiving a force onto side 88 in a third direction 80 for moving second latch 32 in third direction 80 across second aperture 82. Access to side 88 is provided through one of third opening 84 or fourth opening 86.

Moving first latch 28 includes positioning first ledge portion 78 of first latch 28 in abutting relationship with side wall 58 of frame member 34. Moving second latch 32 includes positioning second ledge portion 110 of second latch 32 in abutting relationship with side wall 58 of frame member 34 resulting in female component 24 and male component 22 being placed in a locked position.

Method 116 further includes grasping side 54 of first latch 28 and side 88 of second latch 32 and applying a squeezing force 117, as seen in FIG. 8E, onto side 54 of first latch 28 and onto side 88 of second latch 32 such that the first latch 28 and second latch 32 are moved toward one another. The application of squeezing force 117 results in moving first ledge portion 78 out of abutting relationship with side wall 58 of frame member 34 and moving second ledge portion 110 of second latch 32 out of abutting relationship with side wall 58 of frame member 34, as seen in FIG. 8E, resulting in female component 24 and male component 22 being placed in an unlocked position.

Figure 5:
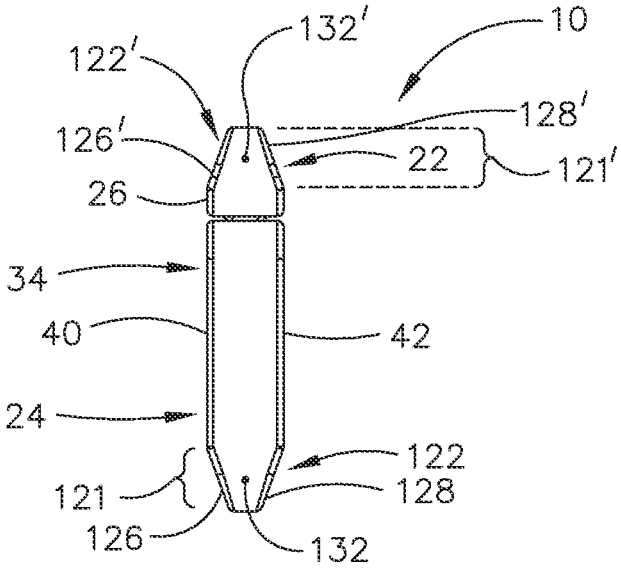
FIG. 5 is an end view of the buckle assembly of FIG. 4 as seen from line 5-5.
Figure 6:
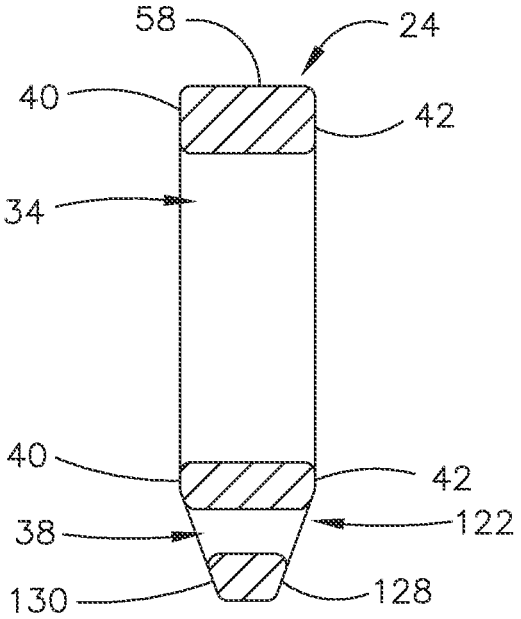
FIG. 6 is a cross section view of the female component along 6-6 of FIG. 2.

Buckle assembly 10 includes, as seen in FIG. 5, male component 22 and female component 24. Male component 22 includes body portion 26 and female component 24 includes frame member 34 as previously discussed. At least one of body portion 26 or frame member 34 has an edge portion which has a tapered configuration. In referring to example of buckle assembly 10 in FIG. 5, both frame member 34 has edge portion 121 having tapered configuration 122 and body portion 26 has edge portion 121' having tapered configuration 122'. However, buckle assembly 10, depending on the desired construction, can have frame member 34 having tapered configuration 122 while body portion 26 does not have a tapered configuration and vice versa in a different construction body portion 26 has a tapered configuration 122' and frame member 34 does not have a tapered configuration. In referring to FIG. 6, an example is shown of female component 24 having tapered configuration 122 and in referring to FIG. 9 female component 24 is shown in use in securing female component 24 to side strap 21.

Figure 4:
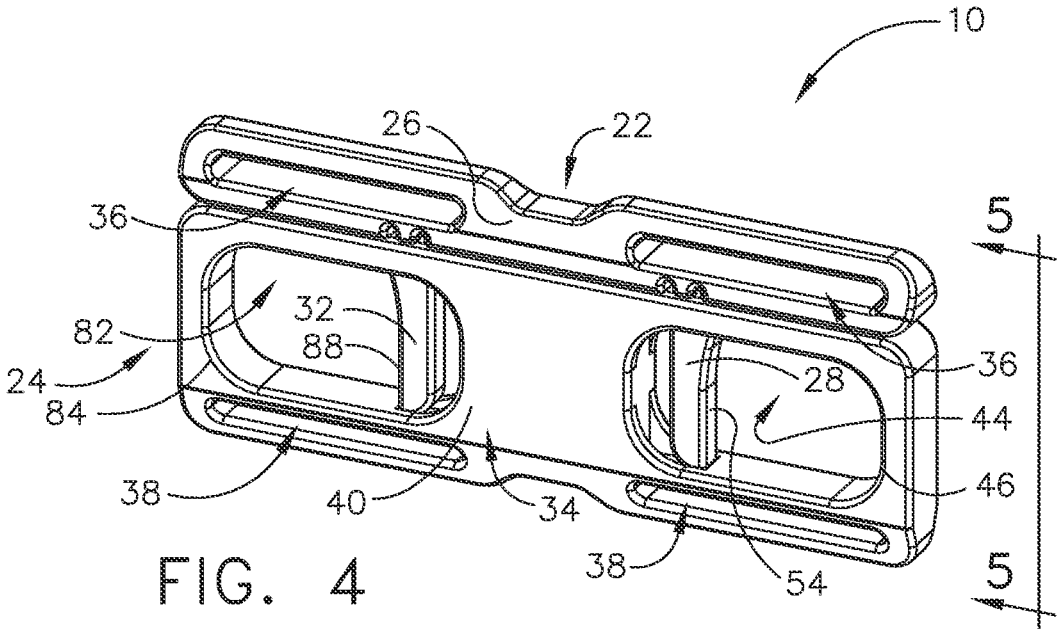
FIG. 4 is a front perspective view of the buckle assembly with the male component and the female component in a locked position.

Buckle assembly 10 has at least one of body portion 26 or frame member 34 define at least one strap slot opening 36. 38, respectively such as seen in FIGS. 2-4. A more detailed view of an example of female component 24 can be seen in FIG. 9, wherein, female component 24 has slot 38 of frame member 34 which receives strap member 16 wherein strap member 16 is positioned in overlying relationship with opposing surfaces 128, 130 of tapered configuration 122. Similarly, an example of male portion 22 is seen in FIG. 5 having opposing surfaces 126' and 128'.

As seen in FIGS. 1 and 2, buckle assembly 10 has body portion 26 of male component 22 defining two strap slot openings 36 and has frame member 34 defining two strap slot openings 38. The number of slot openings positioned within male component 22 and/or within female component 24 is dependent on design selection. In the examples of male component 22 and female component 24 in FIGS. 1-3, each male and female components 22, 24 employ two slots 36 and 38 respectively.

In referring to FIG. 5, buckle assembly 10 is shown such that female component 24 has a tapered edge portion 121 having tapered configuration 122. Similarly in this example male component 22 has tapered edge portion 121' having tapered configuration 122' and would operate similarly to that of female component 24. Either male component 22 or the female component 24 has this tapered construction or both of them have this tapered construction so as to employ the desired securement arrangements.

In the present example discussed, tapered configuration 122, 122' includes opposing surfaces 126, 128 and 126', 128' respectively, as seen in FIG. 5. Opposing surfaces 126, 128 extend symmetrically with respect to axis 132 which extends within edge portion 121 and which extends along length "L" of edge portion 121, as seen in FIGS. 2, 3 and 5. Similarly, opposing surfaces 126', 128' extend symmetrically with respect to axis 132' which extends within edge portion 121' and which extends along length "L'" of edge portion 121', as seen in FIGS. 2, 3 and 5. This configuration provides a streamlined profile which reduces the tapered configuration from receiving impacts from the environment so as to optimize securement of the buckle assembly 10.

In the present example, edge portion 121 and edge portion 121' define slots 38, 36 respectively. Slots 36, 38 provide locations in which a strap or web can be inserted in facilitating connecting buckle assembly 10 to a garment. In referring to the FIG. 9, an example of use of the tapered construction of the female component 24 is shown, which could similarly be applied to male component 22. In this example, the use of tapered configuration 122 of female component 24, provides clearance 127 positioned between side strap 21 of tactical vest 20 and tapered configuration 122 such that strap member 16 is positioned between tapered configuration 122 of tapered edge portion 121 and side strap 21 of tactical vest 20. With strap member 16 positioned within clearance 127, thickness of strap member 16 does not cause female component 24 to be elevated above side strap 21 thereby keeping female component 24 in an otherwise optimal low profile relative to side strap 21, This minimized profile also prevents buckle assembly 10 from being impacted from the environment of operation which may otherwise endanger disengagement of buckle assembly 10 in a locked position or ensnare wearer within the environment of operation.

Moreover, tapered configuration 122 provides contact between strap member 16 and tapered configuration 122 such that with tension applied to strap member 16, force is exerted against tapered configuration 122 in direction 130 toward side strap 21 and the wearer, as seen in FIG. 9. This application of force in direction 130 further stabilizes and secures a low profile of, in this example, female component 24 against side strap 21 and the wearer. The tapered configurations 122, 122' of female component 24 and male component 22, respectively, perform similarly with respect to the example of female component 24 as described and shown in FIG. 9.

As mentioned earlier numerous connector configurations can be used, such as for example to include a closed loop strap member or a free end strap or webbing depending on the securing arrangement desired. In the example shown in FIG. 9, strap member 16 includes a closed loop configuration which is secured to side strap 21 of tactical vest 20 which is secured to tactical vest 20 with stitching 124. Many securements can be used with buckle assembly 10 which included affixed securements to the tactical vest and securements which are adjustable.

While at least one embodiment has been described above, this disclosure is not intended to be limited thereto. Variations can be made to the disclosed embodiment(s) that are still within the scope of the appended claims.

What is claimed:

1. A buckle assembly, comprising:

a male component includes a body portion from which a first latch extends in a first direction; and a female component, comprising a frame member having a first lateral side spaced apart from a second lateral side with a gap positioned therebetween, wherein:

a first aperture extends through the frame member with the first lateral side extending about and defining a first opening of the first aperture, and the second lateral side extending about and defining a second opening of the first aperture;

the gap is in communication with the first aperture and the frame member defines an opening in communication with the gap and the first aperture which permits insertion of the first latch through the opening, through the gap, and into the first aperture so as to extend across a portion of the first aperture, such that with the first latch positioned within the first aperture, the frame member surrounds the first aperture limiting access to a side of the first latch, which is for receiving a force in a second direction, through the first opening or the second opening.

2. The buckle assembly of claim 1, wherein the body portion of the male component defines at least one slot through which a strap member can be extended therethrough.

3. The buckle assembly of claim 1, wherein the frame member of the female component defines at least one slot through which another strap member can be extended therethrough.

4. The buckle assembly of claim 1, wherein the frame member includes a side wall which extends between and along the first lateral side and the second lateral side such that the side wall defines the opening which is in communication with the gap and with the first aperture.

5. The buckle assembly of claim 4, wherein:

the side wall includes a first inclined surface positioned to extend within the gap;

the first inclined surface is positioned between the first lateral side and the second lateral side of the frame member; and a portion of the side wall which includes the first inclined surface extends in the second direction to a first edge of the portion of the side wall which is positioned at an end of the first inclined surface.

6. The buckle assembly of claim 5, wherein:

the first latch has a first portion which has a thinner dimension than a dimension of a second portion of the first latch; and the first portion is positioned between the body portion of the male component and the second portion of the first latch.

7. The buckle assembly of claim 6, wherein:

the first portion of the first latch is recessed from an external surface of the second portion of the first latch; and a first ledge portion extends from the first portion of the first latch to the external surface of the second portion of the first latch.

8. The buckle assembly of claim 7, wherein with inserting of the first latch through the opening and the gap, the first latch slides along the first inclined surface causing the first latch to flex in the second direction such that with having sufficiently inserted the first latch into the first aperture of the frame member, the first ledge portion of the first latch becomes positioned beyond the first edge positioned at the end of the first inclined surface of the side wall resulting in the first latch to flex in a third direction such that the first ledge portion of the first latch is positioned in abutting relationship with the side wall.

9. The buckle assembly of claim 8, wherein with the first ledge portion in abutting relationship with the side wall, the side of the first latch is accessed within the first aperture within the frame member and the force is received by the side in the second direction resulting in flexing the first latch in the second direction and moving the first ledge portion and the side wall out of abutting relationship.

10. The buckle assembly of claim 1, wherein:

the body portion includes a second latch which extends from the body portion in the first direction with the first latch and the second latch spaced apart from one another; and the frame member of the female component, includes:

a second aperture extends through the frame member spaced apart from the first aperture with the first lateral side extending about and defining a third opening of the second aperture and the second lateral side extending about and defining a fourth opening of the second aperture;

the gap positioned between the first lateral side and the second lateral side is in communication with the second aperture; and with inserting of the second latch through the gap and into and across a portion of the second aperture, the frame member surrounds the second aperture limiting access to a side of the second latch, which is for receiving a force in a third direction through the third opening or the fourth opening.

11. The buckle assembly of claim 10, wherein the frame member includes a side wall which extends between and along the first lateral side and the second lateral side such that the side wall defines another opening which is in communication with the gap and with the second aperture.

12. The buckle assembly of claim 11, wherein:

the side wall includes a second inclined surface which extends within the gap;

the second inclined surface is positioned between the first lateral side and the second lateral side of the frame member;

another portion of the side wall which includes the second inclined surface extends in the third direction to a second edge of the other portion of the side wall which is positioned at an end of the second inclined surface;

the second latch has a first portion which has a thinner dimension than a dimension of a second portion of the second latch;

the first portion is positioned between the body portion of the male component and the second portion of the second latch;

the first portion of the second latch is recessed from an external surface of the second portion of the second latch; and a second ledge portion extends from the first portion of the second latch to the external surface of the second portion of the second latch.

13. The buckle assembly of claim 12, wherein with inserting of the second latch through the other opening and the gap, the second latch slides along the second inclined surface causing the second latch to flex in the third direction such that with having sufficiently inserted the second latch into the second aperture of the frame member, the second ledge portion of the second latch becomes positioned beyond the second edge positioned at the end of the second inclined surface of the other portion of the side wall resulting in the second latch to flex in the second direction such that the second ledge portion of the second latch is positioned in abutting relationship with the side wall.

14. The buckle assembly of claim 13, wherein with the second ledge portion in abutting relationship with the side wall, the side of the second latch is accessible within the second aperture within the frame member and the force is applied to the side in the second direction resulting in flexing the second latch in the third direction and moving the second ledge portion and the side wall out of abutting relationship.

15. The buckle assembly of claim 11, wherein:

the male component comprises a guide element secured to the body portion extending in the first direction and positioned between the first latch and the second latch; and the side wall of the female component defines a guide opening which extends into the frame member for receiving the guide element.

16. A method for operating a buckle assembly, comprising the steps of:

inserting a first latch, which extends in a first direction from a body portion of a male component, through an opening defined by a frame member of a female component and into a gap which is communication with the opening wherein the gap is within the frame member of the female component positioned between a first lateral side spaced apart from a second lateral side of the frame member, wherein:

a first aperture extends through the frame member such that the first lateral side extends about and defines a first opening of the first aperture and the second lateral side extends about and defines a second opening of the first aperture; and the gap is in communication with the first aperture; and moving the first latch beyond the gap into the first aperture such that the first latch moves across a portion of the first aperture and with the first latch positioned within the first aperture, the frame member surrounds the first aperture limiting access to a side of the first latch, which is for receiving a force in a second direction, through the first opening or the second opening.

17. The method of claim 16, further includes the steps of:

inserting a second latch of the body portion of the male component, which is spaced apart from the first latch and which extends in the first direction, into the gap positioned within the frame member positioned between the first lateral side spaced apart from the second lateral side of the frame member, wherein:

a second aperture extends through the frame member such that the first lateral side extends about and defines a third opening of the second aperture and the second lateral side extends about and defines a fourth opening of the second aperture; and the gap is in communication with the second aperture; and moving the second latch beyond the gap into the second aperture such that the second latch moves across a portion of the second aperture and with the second latch positioned within the second aperture the frame member surrounds the second aperture limiting access to a side of the second latch, which is for receiving a force in a third direction, through the third opening or the fourth opening;

moving the first latch includes positioning a first ledge portion of the first latch in abutting relationship with a side wall of the frame member; and moving the second latch includes positioning a second ledge portion of the second latch in abutting relationship with the side wall of the frame member, resulting in the female component and the male component being placed in a locked position.

18. The method of claim 17, further includes grasping the side of the first latch and the side of the second latch and applying a squeezing force onto the side of the first latch and onto the side of the second latch such that the first and the second latches are moved toward one another moving a first ledge portion out of abutting relationship with a side wall of the frame member and moving the second ledge portion of the second latch out of abutting relationship with the side wall of the frame member resulting in the female component and the male component being placed in an unlocked position.

* * * * *